US009418517B1

(12) United States Patent
Davis

(10) Patent No.: US 9,418,517 B1
(45) Date of Patent: Aug. 16, 2016

(54) BALL RACE WAGERING GAME APPARATUS AND METHODS OF USE

(71) Applicant: Robert Ray Davis, Litchfield Park, AZ (US)

(72) Inventor: Robert Ray Davis, Litchfield Park, AZ (US)

(73) Assignee: Run The Gauntlet LLC, Litchfield Park, AZ (US)

( * ) Notice: Subject to any disclaimer, the term of this patent is extended or adjusted under 35 U.S.C. 154(b) by 0 days.

(21) Appl. No.: 14/954,930

(22) Filed: Nov. 30, 2015

Related U.S. Application Data

(60) Provisional application No. 62/153,593, filed on Apr. 28, 2015.

(51) Int. Cl.
*A63F 7/02* (2006.01)
*G07F 17/32* (2006.01)

(52) U.S. Cl.
CPC ..... *G07F 17/3267* (2013.01); *G07F 17/3288* (2013.01)

(58) Field of Classification Search
CPC ..... A63F 7/02; A63F 7/022; A63F 7/025; A63F 7/40
USPC ..... 463/6; 273/118 R
See application file for complete search history.

(56) References Cited

U.S. PATENT DOCUMENTS 1,374,844 A 4/1921 Flatow
1,493,649 A 5/1924 Schulz
1,662,162 A 3/1928 Nestor
3,451,678 A 6/1969 Gehrts
3,711,094 A 1/1973 Coffman
4,153,250 A 5/1979 Anthony
4,713,038 A 12/1987 Wichman et al.
5,031,919 A * 7/1991 Dixon ..... A63F 7/0005 273/352
6,155,565 A * 12/2000 Gomez ..... A63F 7/027 273/118 A
6,386,538 B1 5/2002 Mejia
7,267,615 B2 * 9/2007 Rodden ..... G07F 17/3297 273/138.3
8,573,594 B2 11/2013 Watanabe
2003/0073479 A1 * 4/2003 Wilson ..... G07F 17/3213 463/16
2013/0157748 A1 6/2013 Burford

* cited by examiner

*Primary Examiner* — Allen Chan

(74) *Attorney, Agent, or Firm* — Invention To Patent Services; Alex Hobson

(57) ABSTRACT

A rolling ball-race betting apparatus has at least two decline planes with deflectors to allow balls to race down along the decline planes into a collector. A person may place any number of different types of wagers on a race result, such as selecting one ball to win. Each ball in the ball-race apparatus has a designation such as a number, symbol, color or other marking. A ball-race apparatus may have stops, wherein one or more of the balls may be trapped in the stop and will not finish the race. A person may place a wager on one or more balls to not finish the race. A ball-race apparatus may have a shortcut conduit that transfers balls from the first decline plane to the second decline plane. A ball race game apparatus may include a spinning deflector that is configured to hit and propel the balls in any number of directions.

20 Claims, 11 Drawing Sheets

BALL RACE WAGERING GAME APPARATUS AND METHODS OF USE

CROSS REFERENCE TO RELATED APPLICATIONS

The present invention claims the benefit and priority to U.S. provisional patent application No. 62/153,593, filed on Apr. 28, 2015 and entitled, Ball Race Wagering Game Apparatus and Methods of Use.

BACKGROUND OF THE INVENTION

1. Field of the Invention

The present invention relates to a ball race wagering game apparatus and methods of use.

2. Background

Many people enjoy wagering on various types of races, including horse and dog races. This type of wagering activity provides a unique experience as those wagering can root for the winner. The anticipation builds until the winner crosses the finish line. In addition, racing events provide a wide range of wagering options, including win, place, show, trifecta, exacta, quinella, and the like. Unfortunately, horse and dog races take a considerable amount of time and money to set up and operate. Race tracks for horse and dog races often do not have other casino type gaming which makes the activities limited at these venues. Furthermore, there is typically a long period of time between races. Those interested in wagering on successive races have to wait a rather long time between races. There exists a need for a racing game that is quick and easy to operate and can be located within casino or race track venue.

SUMMARY OF THE INVENTION

The invention is directed to a ball race wagering game apparatus and methods of use. A ball race wagering game apparatus comprises a plurality of runs comprising a decline plane and deflectors whereby a plurality of balls roll from a starting elevated end to a lower finish end. In an exemplary embodiment, a ball race wagering game apparatus comprises first and second runs that are aligned and offset vertically from each other. The first decline plane has an elevated starting end and a lower end that is above the starting end of a second decline plane. In this embodiment, a plurality of balls drop from the lower end of the first decline plane to the starting end of the second decline plane. Each run may comprise a plurality of deflectors, whereby balls rolling down the decline planes will randomly impact with the deflectors to change their direction. In one embodiment, a shortcut conduit is configured between the first and second decline planes. In another embodiment, the ball race game apparatus comprises a rotating deflector that may propel balls back up the decline plane. In still, another embodiment, one or more stops are configured on a decline plane to trap and hold a ball and prevent it from finishing the race, or reaching the finish line.

The ball race wagering game apparatus provides opportunities to wager on the outcome of a race. Any suitable type of wager is contemplated including those typical of horse race betting such as, win, place show, trifecta, superfecta, quinella, exacta and the like. The ball race wagering game apparatus provides some additional types of wagering including wagering on a ball not to finish, wagering on a select number or subset of balls to finish first. For example, in one embodiment, the balls may have ball designations like those of 16 billiard balls with fifteen numbered balls and a que ball. There may be seven with a stripe and seven being solid in color. A person may wager on any of the solids to finish first for example. In addition, a person may wager on a color designation to finish which may include two balls, one from the striped group and one from the solid group. Any suitable manner to place the bets are contemplated including a betting table or mat having specific wagering designations for the placement of chips, much like a roulette table. In one embodiment a betting surface, or table is provided with a plurality of different betting locations, each having a betting designation such as ball number, color, stripes; much like that of a roulette-betting table. A person may place a wager on one or more of the betting locations and receive a winning equal to the odds for that wager. Another wagering method includes placing a wager by writing down or otherwise communicating a wager. A betting slip may be handed in or a person may simply verbally communicate their wager to an attendant at a wagering window, for example. Still another way to place a wager is a combination of the betting table and communication to an attendant that facilitates wagering at the betting table. A person may write down their wager on a slip and hand it to a betting table attendant, who then places their wager on the table. In still another embodiment, a person may place a wager through an interface with an electronic device, such as a computer configured as a wagering station, or kiosk. A portable electronic device may be configured to place wagers as well, such as a mobile phone or tablet computer. Any suitable method of placing a wager and combinations thereof may be employed in the present invention.

A run and decline plane may have any suitable dimensions or aspect ratio of length to width. A decline plane may have a length that is about 0.5 m or longer, about 1 m or longer, about 2 m or longer and any range of lengths between and including the lengths listed. A decline plane may have any suitable width and in an exemplary embodiment, the width is no more than one-half the length. The aspect ratio of length to width of the decline plane may be 1.5 or more, 2 or more, 3 or more, 5 or more 10 or more and any range between and including the aspect ratios provided.

A run may have any number of deflectors including five or more, eight or more, ten or more, twenty or more, and any range between and including the number of deflectors provided. A first run and second run may have the same or similar number of deflectors or one run may have more deflectors than the other run, such as 1.5 times more, 2 times more, 3 times more and the like. A deflector may be a discrete deflector that is not coupled with or extends from a wall of the game apparatus. A discrete deflector may have a perimeter that is free standing and not coupled to any side or end wall. A deflector may be a wall deflector, or a deflector that is coupled with and extends from a wall of the game apparatus, such as a side-wall or end wall, for example. A game apparatus may comprise one or more roll-deflectors, or a deflector that has an elongated linear surface that is at least three times longer than the diameter of a ball used in the ball race game, wherein said ball may roll along the roll deflector. An elongated linear surface of a roll-deflector may extend across the width of a decline plane and be configured at some offset angle to the length axis of the decline plane. A decline plane may comprise a channel deflector, or a pair of roll-deflectors that are oriented to guide a ball down to a channel opening or space between the two roll-deflectors. A channel deflector may comprise a pair of roll deflectors that extend from opposing side-walls of the game apparatus toward the center-line of the decline plane where there is a space through which one or more balls are allowed to roll.

A deflector may have any cross-sectional shape across the vertical extended axis, such as circular, triangular, square, rectangular, elongated, irregular and the like. A deflector may extend up from a decline plane surface or from a top, bottom or side-wall. A deflector may have a height, or length extension from the decline plane surface that is greater than the diameter of the balls used in the ball race game apparatus. A deflector may have flat or planar surfaces, as is the case with deflectors that are blocks, or may comprise curved or rounded surfaces as is the case with a cylindrical type deflector. In an exemplary embodiment, a run comprises a plurality of square block deflectors having planar surfaces that extend up from the decline plane surface to provide an impact surface for the balls. In another embodiment, a run comprises deflectors having curved surfaces, such as a cylindrical shaped deflector that extends up from the decline plane. A run may, comprise block shaped deflectors, having planar surfaces for contact with the balls, for example. In another embodiment, a deflector may have a height that is less than the diameter of the ball and a ball, may, in some cases, hit and travel over the deflector.

A ball race game apparatus may comprise one or more stops that are configured to stop and retain a ball from rolling down the decline plane. A stop may be a discrete stop that is configured within the decline plane and not coupled with a side or end wall of the run. A discrete stop may comprise two deflector extensions that form a pocket or V-shape to capture a ball as it rolls down the decline plane. A stop may also be configured as a wall stop, or along a side or end wall, and comprise a deflector that extends from the wall in a manner to capture a ball. For example, a wall stop may extend from a wall up toward the elevated end to form a pocket to trap and retain one or more balls.

A run may comprise a spinning deflector configured to impart energy into a ball that contacts it. A spinning deflector may be any suitable shape, including block shaped and may comprise an activation button that enables a user or wagering person to press the activation button as desired. In one embodiment, a spinning deflector may impact a ball, and propel it up the decline plane, thereby increasing the time for that ball to finish.

Between runs there may be a transfer conduit configured to move the balls from the lower end of the first decline plane to the elevated starting end of a subsequent decline plane. A transfer conduit may be a tube having a transfer inlet on the first decline plane and a transfer outlet configured to deliver balls to a second decline plane. The lower end of the first decline plane may be elevated in height from the starting end of the second decline plane. A transfer conduit may be configured to drop the balls from the first decline plane to the second decline plane.

A ball race wagering game apparatus may comprise a shortcut conduit that is configured to allow one or more balls to pass from a first decline plane to a second decline plane and bypass one or more deflectors. A shortcut conduit may have an inlet that is configured some distance from the lower end of a first decline plane and an outlet that is configured some distance down from the starting end of a second decline plane. A shortcut tunnel may be sized to only allow one ball at a time to pass through the conduit or may be larger to allow two or more balls to pass, through at one time.

An exemplary ball race wagering, game apparatus comprises a starting block configured to hold a plurality of balls for the start of a race. A starting block may comprise a stop or recesses to hold the plurality of balls and prevent them from rolling down the first run. A trigger or lever may be coupled with a starting block to allow the release of the balls to start the race. A starting block may be configured at some height above the starting end of the first run or decline plane. At the beginning of a race, the plurality of balls may be released from this elevated height and drop down onto the first decline plane. A ball race wagering game apparatus may also comprise a starting chamber, or a confined area wherein the plurality of balls can bounce before exiting the starting chamber to roll down the first decline plane. A starting chamber may comprise a transparent starting shield configured to allow participants in the ball race wagering game to view the balls within the starting chamber.

An exemplary ball race wagering game apparatus comprises a finish collector configured to collect the plurality of balls in the order in which they finish the ball race. In an exemplary embodiment, the finish collector collects the balls in line, with the first ball to finish at the bottom of the collector, and second ball to finish next to the first and so on. A finish collector may have finish indicators to show the finish order of the balls.

Any suitable type of balls may be used in the ball race wagering game apparatus and any suitable type of ball indicator may be configured on the ball. In an exemplary embodiment, the balls have ball indicators resembling those of common billiard balls, with numbers one through fifteen and having different colors. Standard billiard balls include balls numbered 1 to 7 that have different colors and balls numbered 9 to 15 that have a corresponding striped color, and a ball numbered 8 that is black. In addition, a white cue ball is used in billiards making the total number of balls sixteen. Any number of balls may be used in the ball race wagering game apparatus however, including at least three, at least five, at least ten, at least fifteen, at least 20 and any range between and including the number of balls listed. A ball used for the ball race wagering game apparatus may be a hard ball, such as those used in billiards, or a ball that is elastic and bounces, such as a Super-ball available from Gumballs Inc., and having a 32 mm diameter. Super-balls come in a range of diameters, from 27 mm to 49 mm for example.

A ball race wagering game apparatus may have any number of runs and in an exemplary embodiment, a first and a second run are configured in line with each other. A first run may be configured at some offset angle or any other orientation with respect to the first run.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEW OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
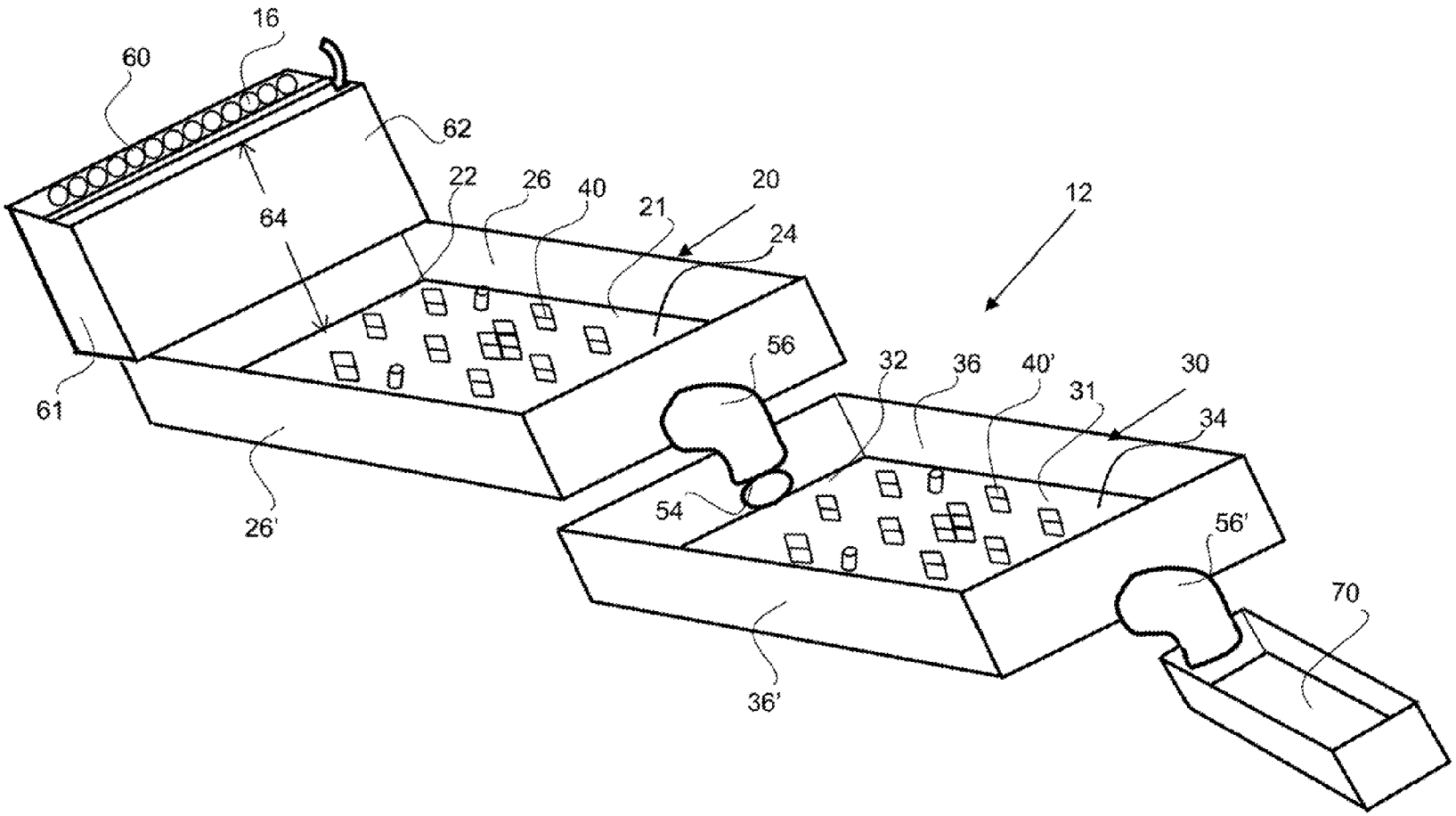
FIG. 1 shows a perspective view an exemplary ball race wagering game apparatus having a first run that is vertically offset from a second run.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover, non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary ball race wagering game apparatus 12 has a first run 20 that is vertically offset from a second run 30. A plurality of balls 16 are configured in a starting block 60 that is vertically offset from the first decline plane 21. A starting chamber 61 is configured to retain the balls as they drop from the starting block to the first run. The start drop height 64 is indicated in FIG. 1. A starting shield 62 is configured over the front face of the starting chamber 61 to allow participants to view the balls as they drop and bounce within the starting chamber. The first run 20 comprises a decline plane 21 and two opposing side walls 26, 26'. A plurality of deflectors 40 are configured along the run to deflect the plurality of balls as they roll down the decline plane from the elevated starting end 22 to the lower end 24. A transfer conduit 56 is configured to transfer balls from the first run to the second run. A shortcut outlet 54 is shown configured in the elevated end wall of the second run. The second run 30 comprises a second decline plane 31 having side walls 36, 36' and a plurality of deflectors 40'. The second run has an elevated starting end 32 and a lower end 34. A transfer conduit 56' is configured to transfer the balls from the lower end of the second run to the finish collector 70.

Figure 2:
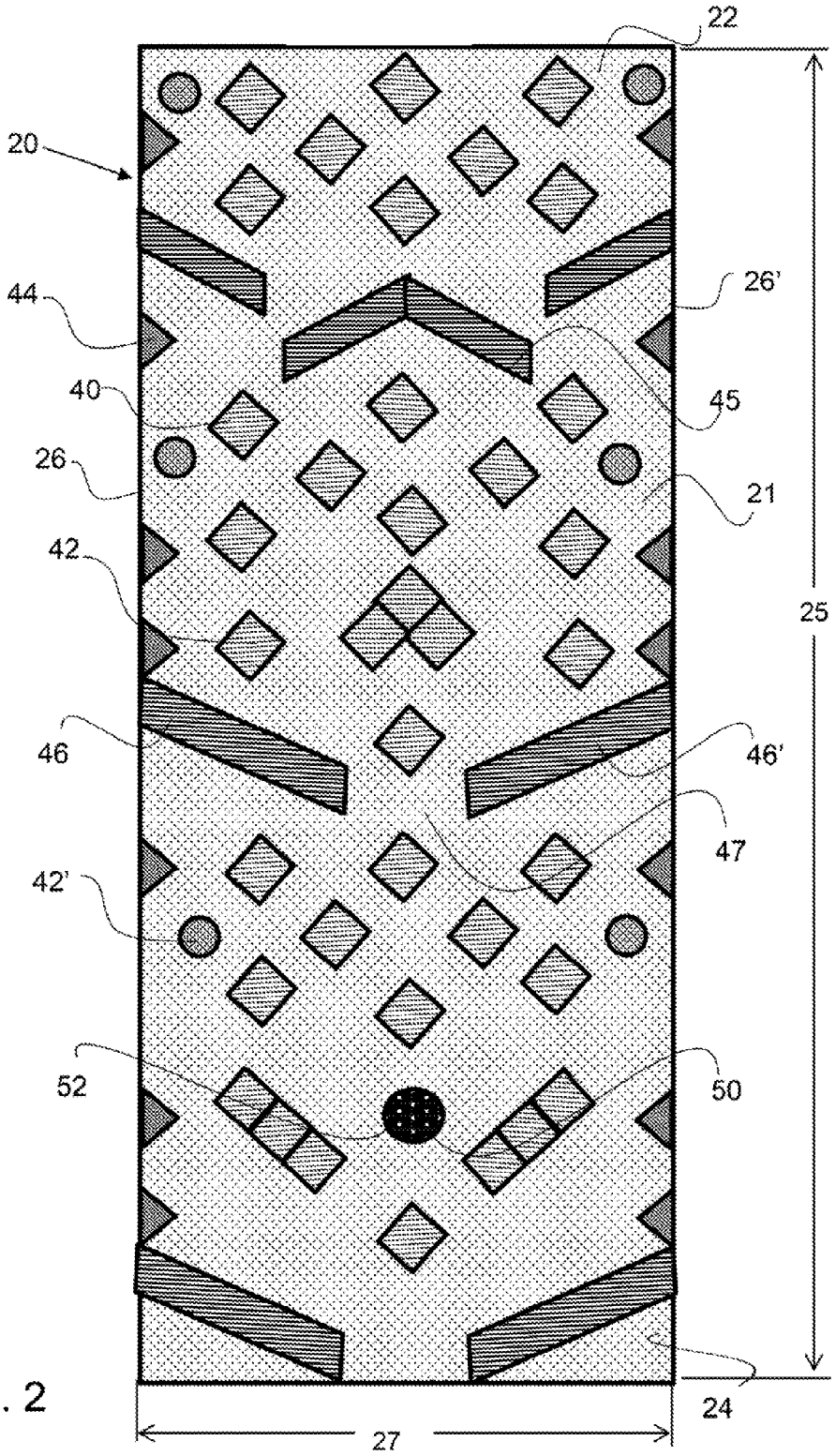
FIG. 2 shows a top down view of an exemplary first run having a plurality of deflectors and an inlet to a shortcut conduit.

As shown in FIG. 2, an exemplary first run 20 has a plurality of deflectors 40 and an inlet 52 to a shortcut conduit 50. The exemplary first run comprises a plurality of different types of deflectors. Block and cylindrically shaped discrete deflectors 42, 42' are configured along the length 25 and width 27 of the decline plane 21. A number of triangular shaped wall deflectors 44 extend from the side walls 26, 26'. A roll deflector 45 is configured proximal to the elevated starting end 22 of the first run has a length that is at least three times that of the diameter of the balls. The exemplary first run comprises channel deflectors 46, 46' that extend from the side walls and produce a channel that guides the balls through the channel opening 47. The exemplary first run comprises more than ten discrete deflectors and more than ten wall deflectors.

Figure 3:
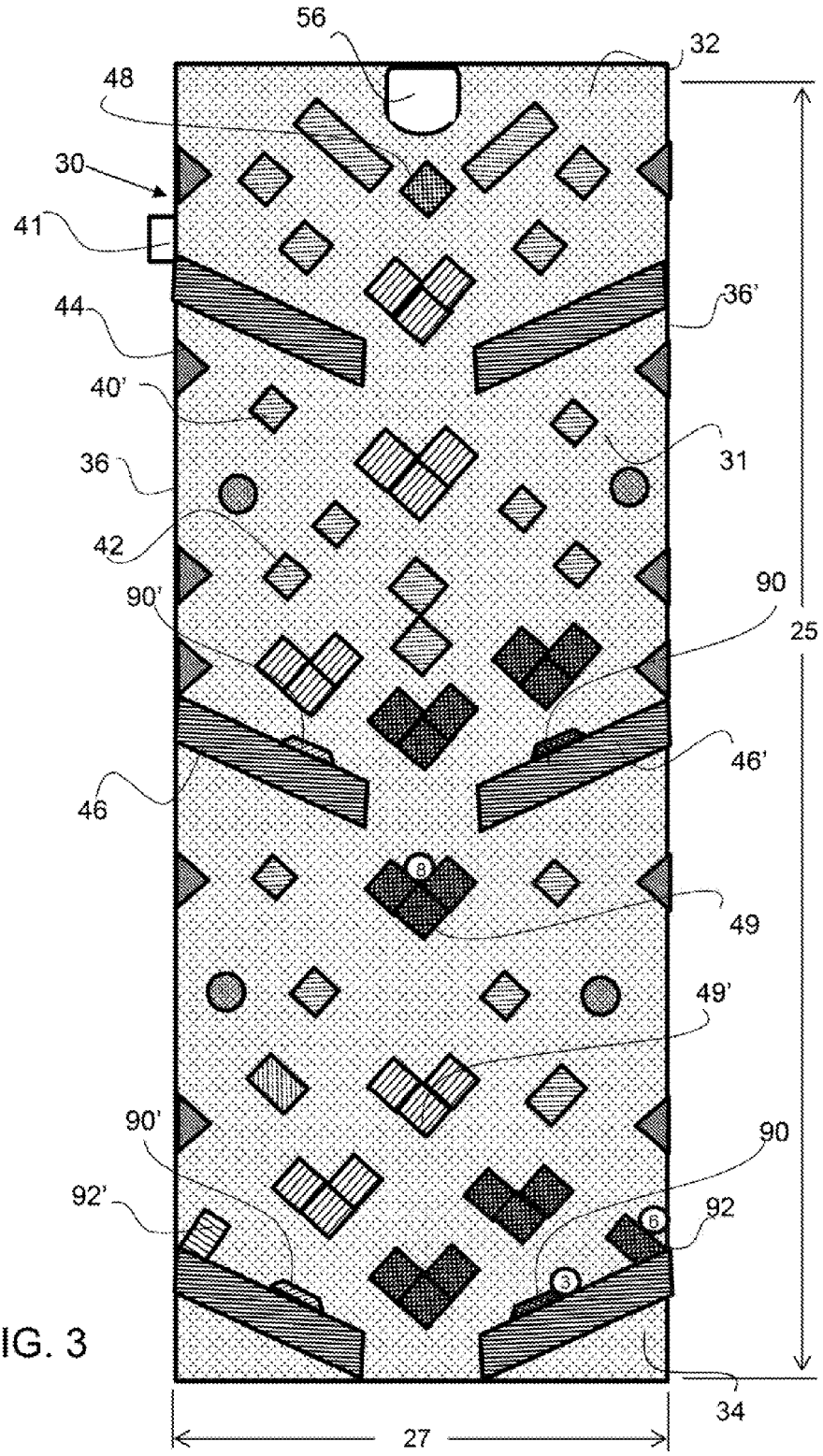
FIG. 3 shows a top down view of an exemplary second run having a plurality of deflectors, a rotating deflector, and a plurality of red and black stops.

As shown in FIG. 3, an exemplary second run 30 has a plurality of deflectors 40. The second run comprises discrete deflectors 42, wall deflectors 44, and channel deflectors 46, 46'. In addition, the exemplary second run comprises stops different color stops, 49, 49' configured to stop and retain a ball as it rolls down the decline plane 31 from the elevated starting end 32 to the lower end 34. Some of the stops 49 are a first color, such as black, and some of the stops 49' are a second color, such as red. Having two or more different colors provides additional wagering designations, such as betting not only on a ball being stopped and not finishing the ball race game, but also designating what color stop the ball is stopped in. There are also four channel stops, 90, 90, 90', 90' shown in this embodiment. Channel stops are stops configured along the length of the channel deflectors 46, 46' and channel stop 90 are a first color, black, and channel stops 90' are a second color, red. There are four total channel stops shown in this exemplary run of the ball race apparatus, two on the second channel deflectors from the starting end 32 and two on the third channel deflectors from the starting end. In addition, there are also two side stops, 92, 92' shown in this embodiment. Side stops are stops, configured along the side walls 36, 36', of the second run 30 and are configured to stop a ball proximal or in contact with the side wall. As shown in this embodiment, there are two side stops, 92, 92' configured proximal to the third channel deflector from the starting, end 32. Side stop 92 is a first color, black, and side stops 92' is a second color, red. There may be any number of side stops configured along the first or second runs of the ball race apparatus. In addition, the second run comprises a spinning deflector 48 configured proximal to the elevated starting end 32. The spinning deflector is configured to spin and impart energy to the balls when they come in contact with the spinning deflector. An activation button 41 is configured on the side of the second run to turn on the spinning deflector. As described a participant in the ball race wagering game may push the activation button as desired to provide interaction with the game. A total of eight black stops and eight red stops are shown in FIG. 3. There are five discrete red stops and five discrete black stops, two red channel stops and two black channel stops, and one side stop that is black in color and one that is red in color. As described any combination of stop type and quantity may be configured along a run of the ball race apparatus. As shown in FIG. 3, ball number 8 is stopped in a black discrete stop 49 and is the last place finisher ball, as it is stopped highest up on the second decline plane. Balls with the number 3 and number 6 designation are also stopped on the second decline plane but they are below the number 8 ball. In the event that no balls are stopped on the second decline plane, the last place finisher ball is the ball that enters into the finish collector last. As shown in FIG. 3, ball number 6 is stopped along side wall 36' and in black side stop 92. As shown in FIG. 3, ball number 3 is stopped in the black channel stop 90.

Figure 4:
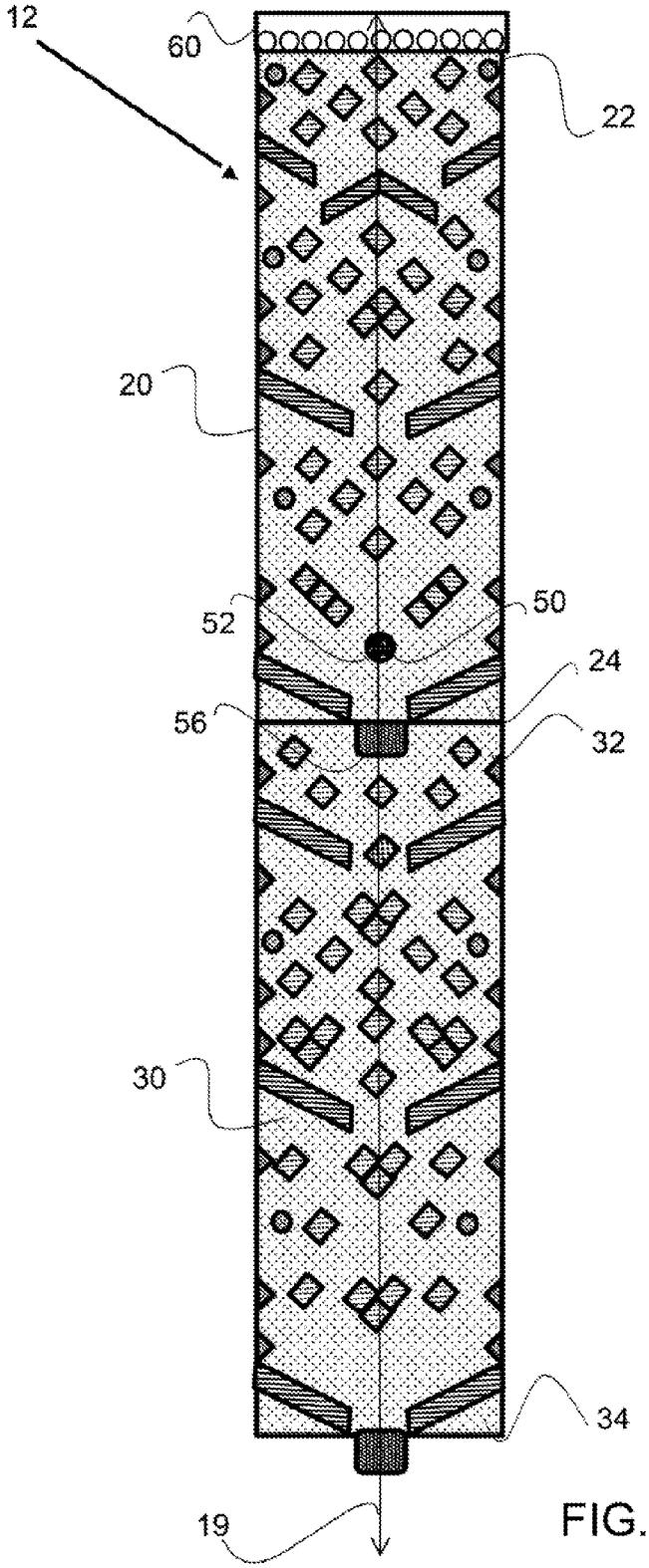
FIG. 4 shows a top-down view of exemplary ball race wagering game apparatus having first and second runs substantially aligned with each other.

As shown in FIG. 4, an exemplary ball race wagering game apparatus 12 has a first run 20 and a second run 30 that are substantially aligned with each other. The first and second runs are aligned along a centerline 19 that extends along the length and substantially along the center of the width of the decline planes. A transfer conduit 56 is configured over the channel opening at the lower end 24 of the first run 20. The transfer conduit transfers the plurality of balls from the first run 20 to the second run 30.

Figure 5:
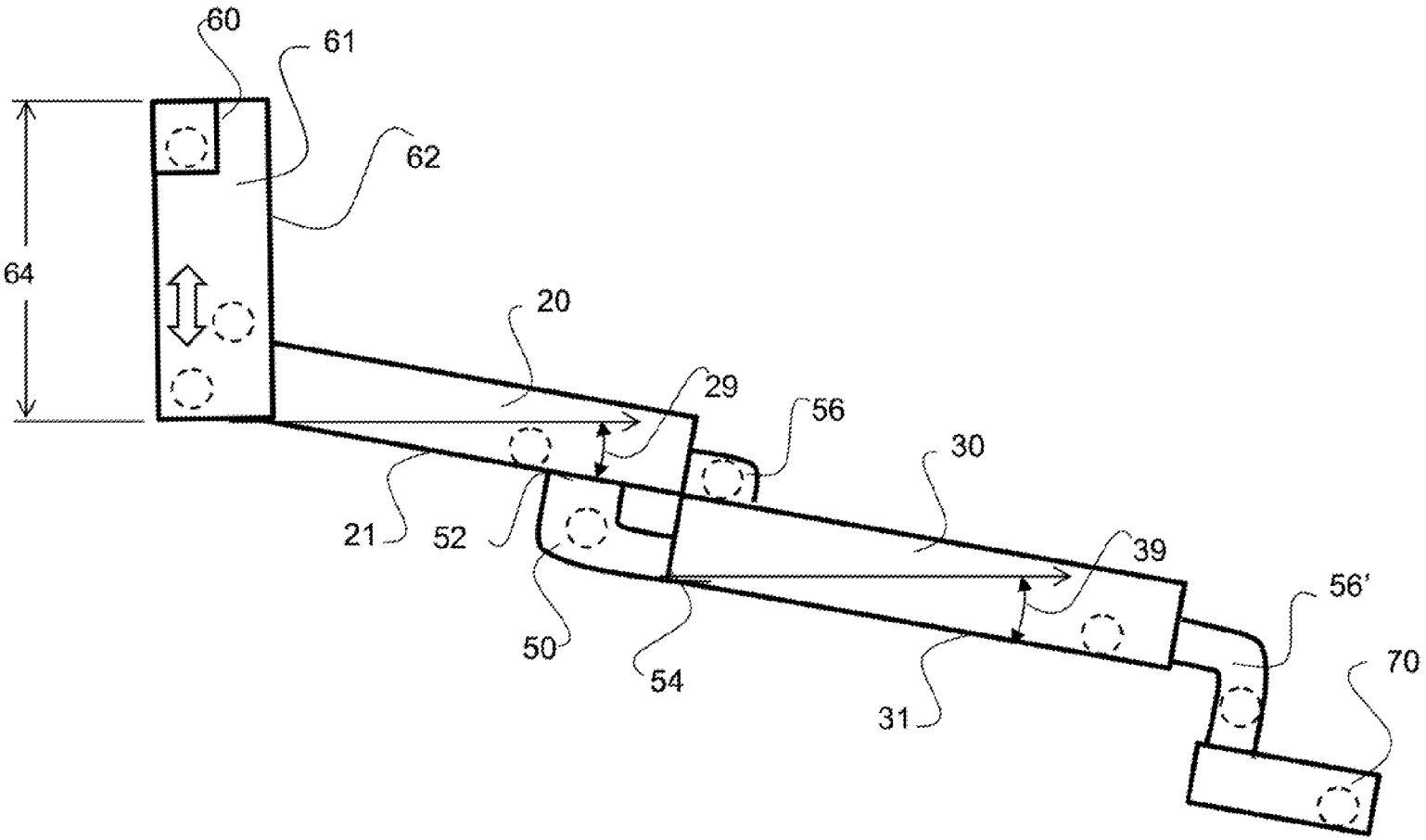
FIGS. 5 to 7 show side views of an exemplary ball race wagering game apparatus having a shortcut conduit between the first and second runs.
Figure 6:
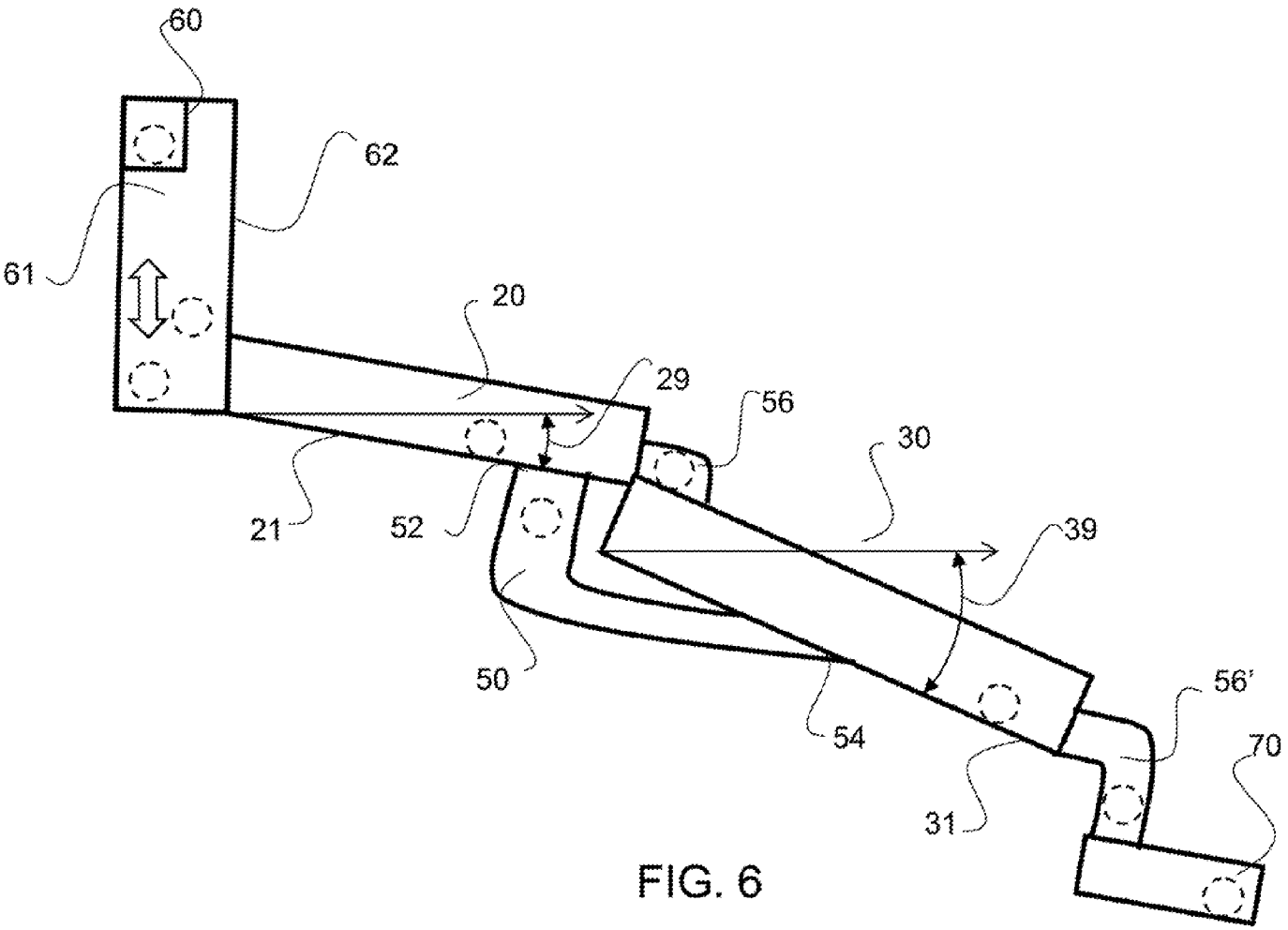
Figure 7:
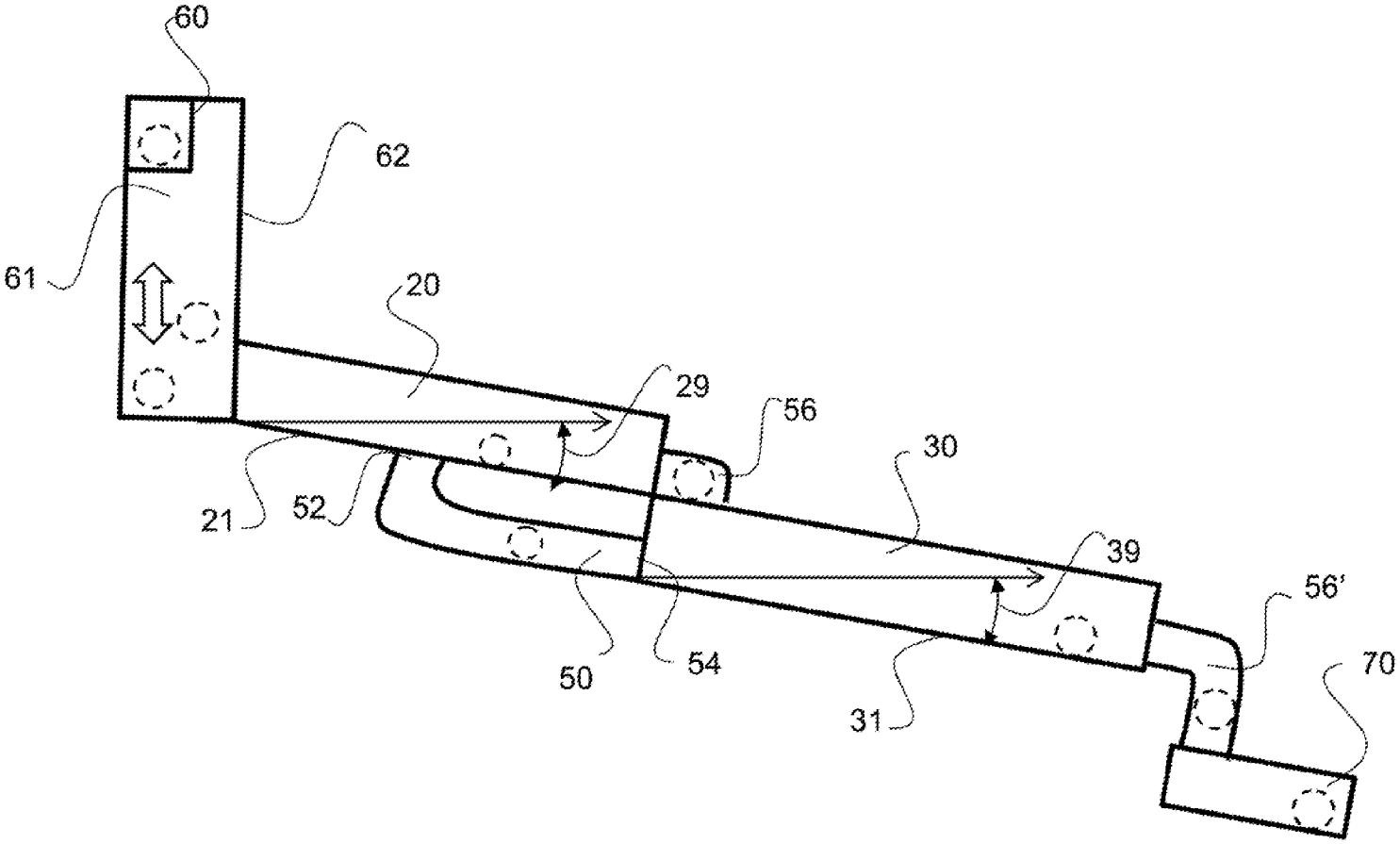

As shown in FIGS. 5 to 7 an exemplary ball race wagering game apparatus has a shortcut conduit 50 between the first run 20 and second run 30. The shortcut conduit has a shortcut inlet 52 along the decline plane 21 of the first run and a shortcut outlet 54 that delivers the balls to the second decline plane 31. The inlet and outlet of the shortcut conduit is configured in different locations as shown in FIGS. 5 to 7. In FIG. 5, the shortcut outlet is configured in the upper end wall, of the second run. In FIG. 6, the shortcut outlet is configured further down the length of the decline plane. In FIG. 7 the shortcut inlet is configured further up the length of the first decline plane.

Also shown in FIGS. 5 to 7 is a starting block 60 configured to retain the balls prior to the start of the race and a starting chamber 61 configured to retain the balls as they drop and bounce, as indicated by the double ended arrow, within the chamber. The start drop height 64, or height the balls will drop is shown in FIGS. 5 to 7. The starting chamber 61 is configured with a transparent starting shield 62 configured to allow participants to view the balls as they are released from the starting block and bounce within the starting chamber. Also shown in FIGS. 5 to 7, is a transfer conduit 56 between the first and second runs and a transfer conduit 56' between the second run 30 and the finish collector 70. Also shown in FIGS. 5 to 7 is the decline angles of the first decline plane 29 and the second decline plane 39. A decline angle, as shown, is the angle from horizontal or level, of the decline plane.

Figure 8:
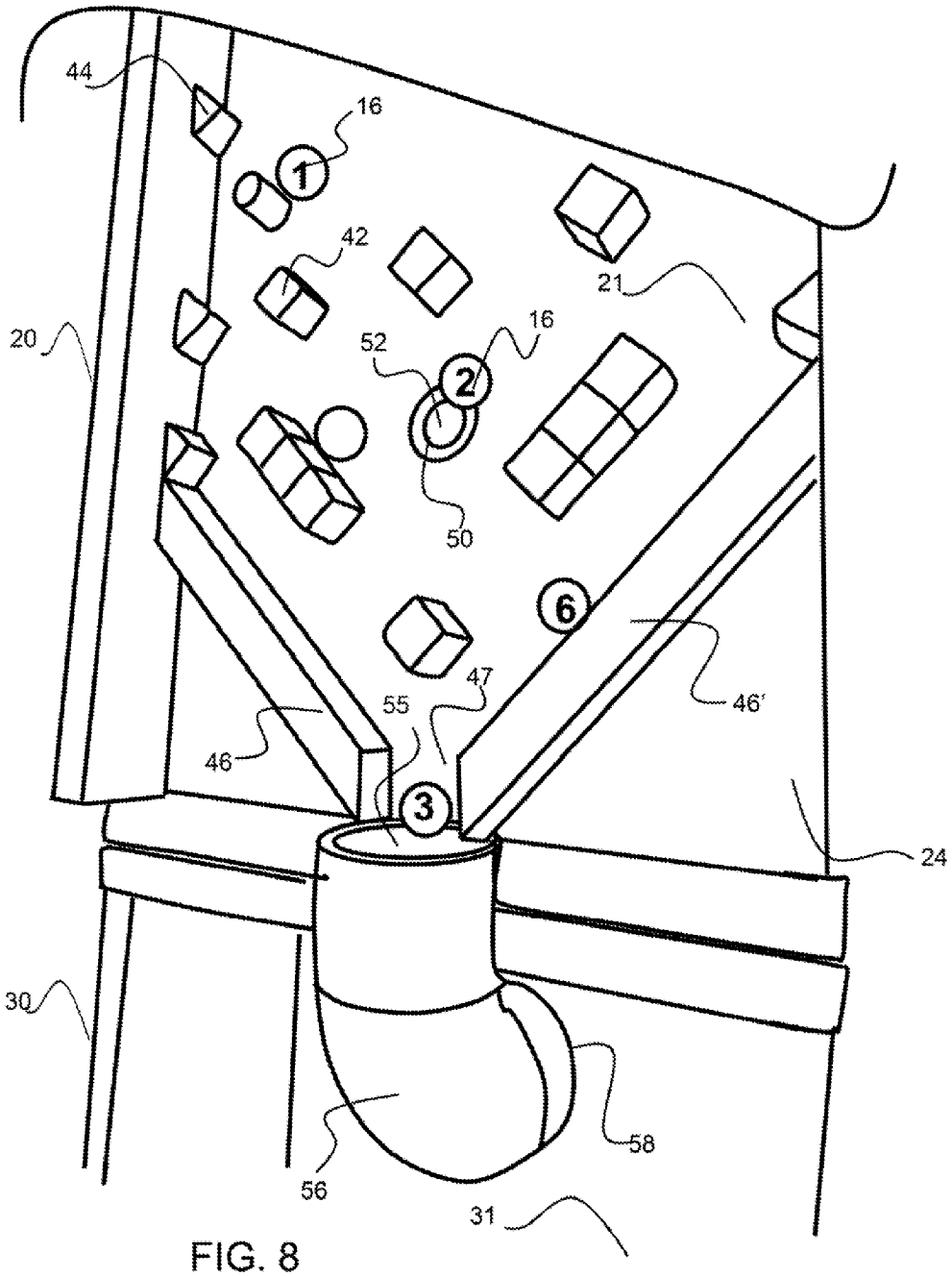
FIG. 8 shows a perspective view of the lower end of an exemplary first run having a shortcut conduit inlet.

As shown in FIG. 8, the lower end of an exemplary first run 20 has a shortcut conduit inlet 52 and a ball with the number 2 designation is approaching the shortcut conduit. A channel deflector 46 is configured at the lower end 24 of the first run 20 to direct balls into the transfer conduit 56. The transfer conduit, inlet 55 is positioned across the channel opening 47, whereby balls directed by the channel deflector will enter into the transfer conduit 56. The transfer conduit outlet 58 is configured to deliver balls to the decline plane of the second run 30. The first run 20 comprises a plurality of block shaped discrete deflectors 42 and wall deflectors 44.

Figure 9:
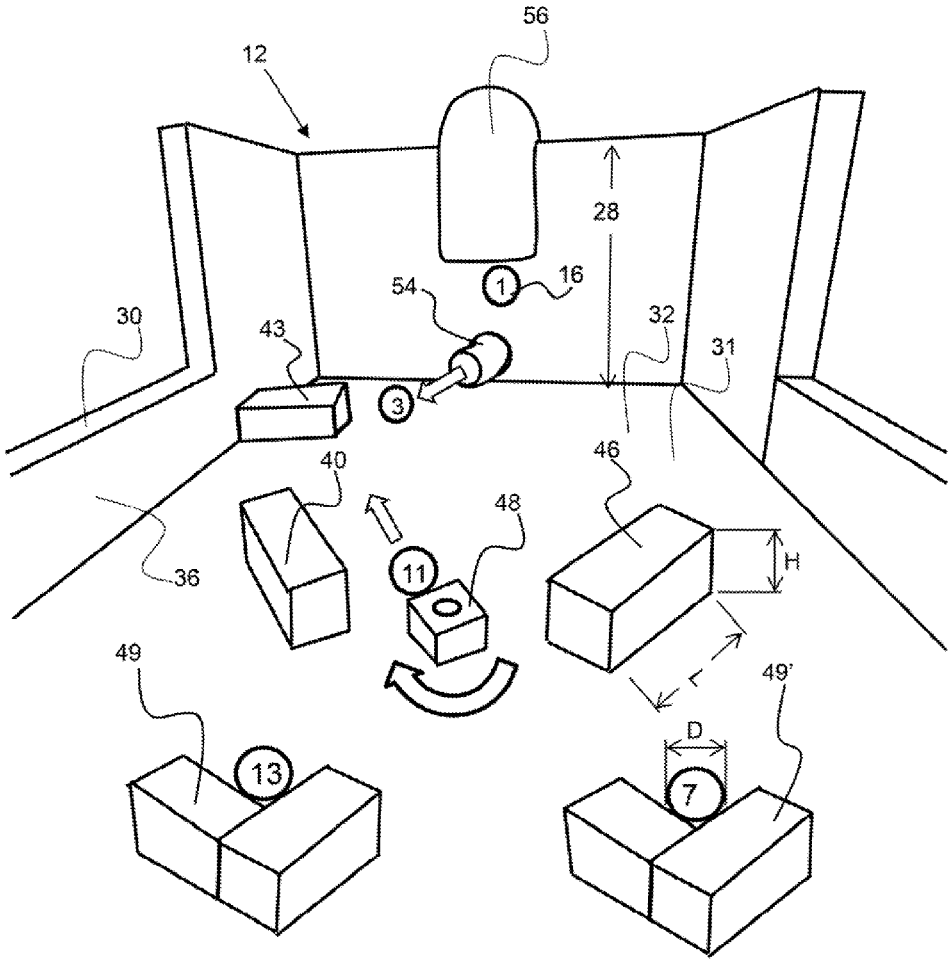
FIG. 9 shows a perspective view of the starting end of an exemplary second run having a shortcut conduit outlet and a rotating deflector.

As shown in FIG. 9, the elevated starting end 32 of an exemplary second run 30 has a shortcut conduit outlet 54 and a spinning deflector 48. The spinning deflector spins about an axis that is perpendicular to the decline plane. Ball number 11 has hit the spinning deflector and is being propelled up the decline plane, as indicated by the bold arrow. The shortcut conduit outlet 54 is configured in the end wall of the second run. Ball number 3 has just emerged from the shortcut conduit onto the decline plane 31. A plurality of deflectors 40 are configured on the second run. The channel deflector 46 has a height H that extends up from the decline plane and a length L. The balls have a diameter D, as indicated on ball number 7. The diameter of the balls is less than that of the height of the deflectors. Balls, number 13 and number 7, are retained in the stops 49 and 49' respectively. A wall stop 43 is shown extending from side wall 36. The drop height 28 between the first decline plane and second decline plane is shown.

Figure 10:
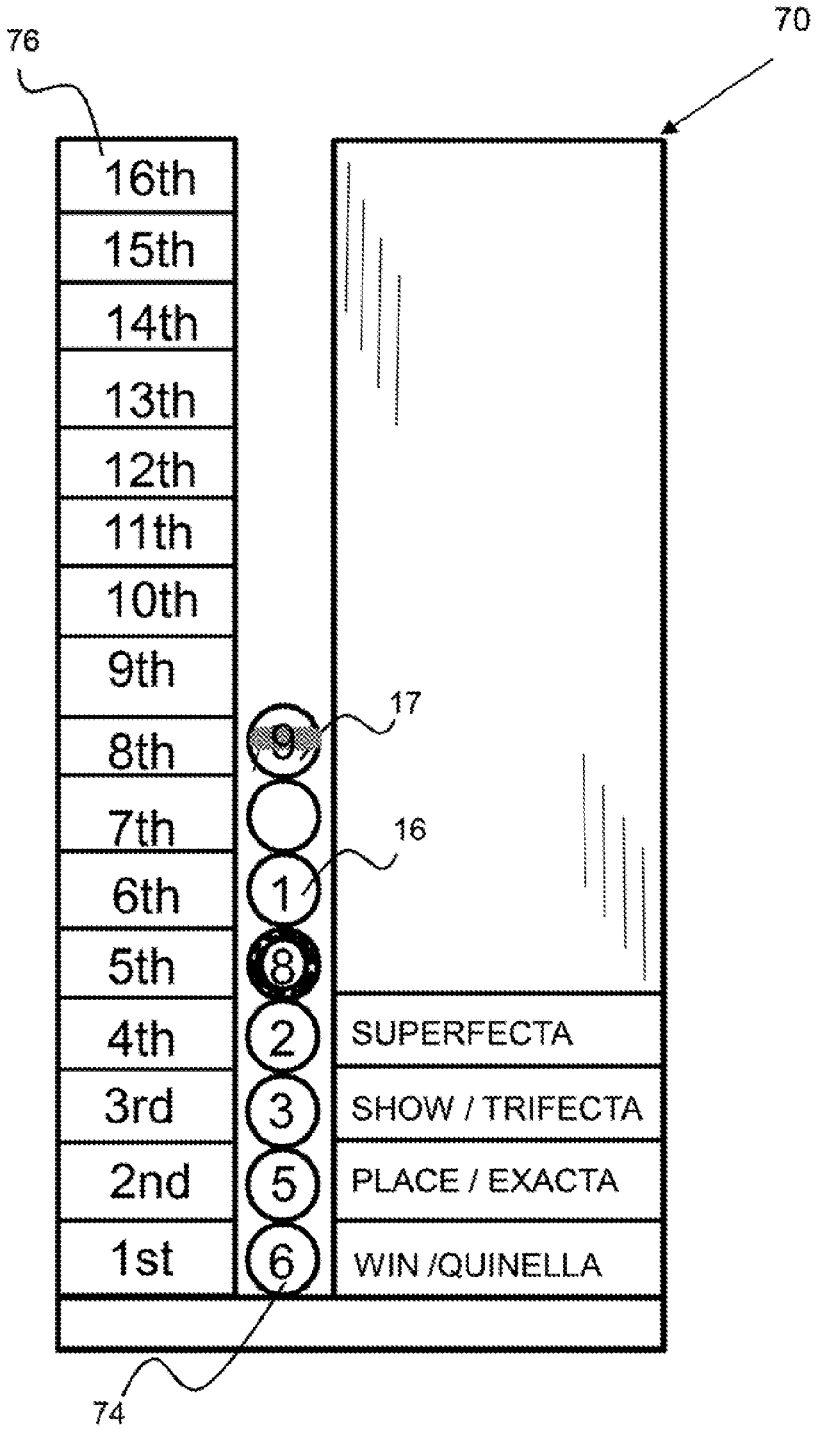
FIG. 10 shows a finish having place finish indicators.

As shown in FIG. 10, an exemplary finish collector 70 has place finish indicators 76. The balls are collected in a row or in series in the order in which they finished the race. Each ball has a finish place, such as first, second, third, fourth place, etc. Ball number 6 finished in first place, ball number 5 finished in second place and ball number 3 finished in third place. The number 8 ball, having a black color designation, finished in fifth place and the cue ball, having a white color designation, finished in seventh place. Each ball 16 has a designation, including color and/or a number designation. The ball with the number 9 designation 17 is a striped color ball. The ball with the number 6 designation 74 is a solid color ball and is the first place finisher of the ball race game.

Figure 11:
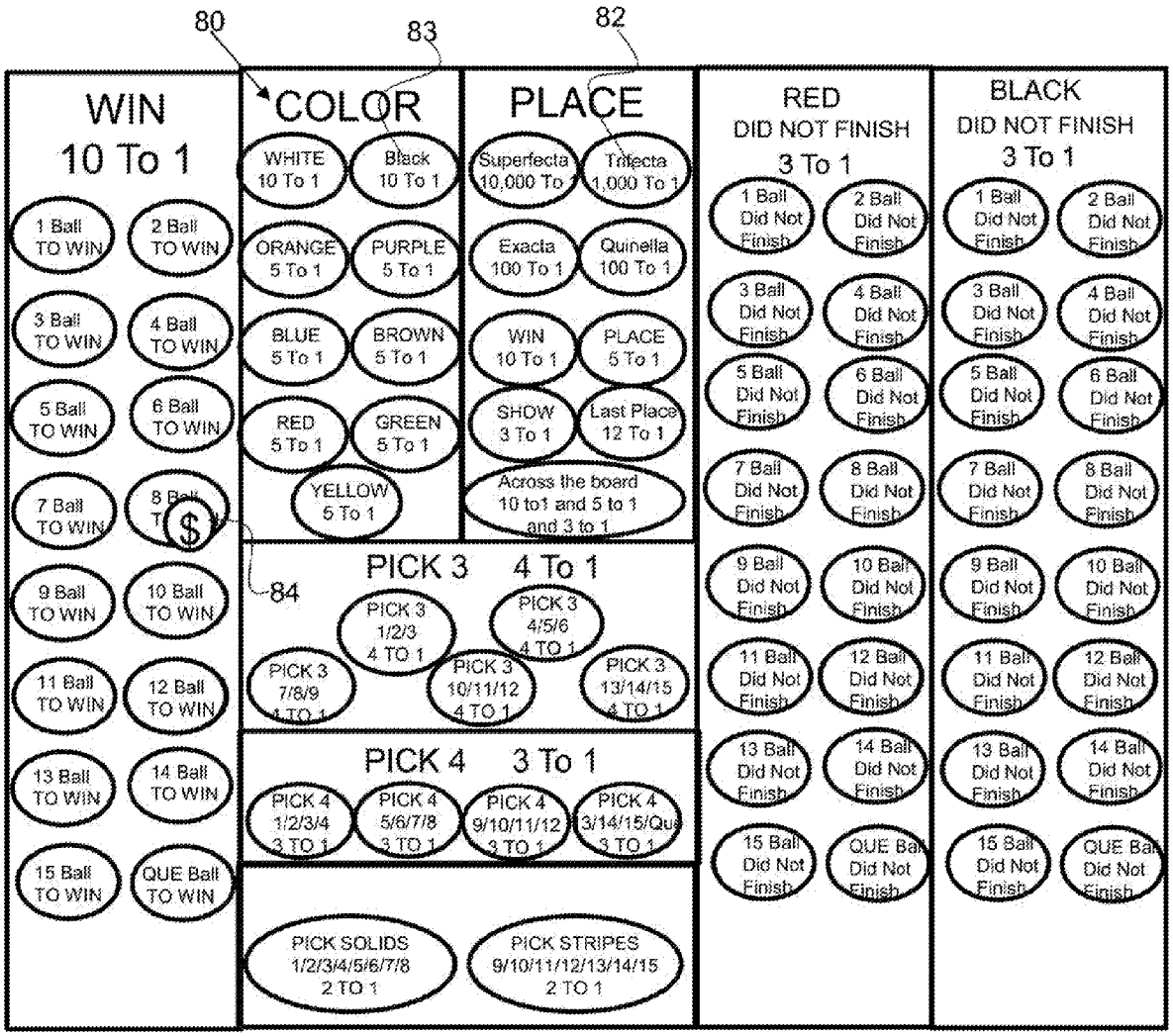
FIG. 11 shows an exemplary wagering mat having a plurality of wagering types that corresponds with the ball race apparatus shown in FIG. 3.

FIG. 11 shows an exemplary betting surface 80 or betting table, such as a tabletop, or mat, having a plurality of betting locations 82. The betting locations each have a betting designation 83. This exemplary betting surface 80 has betting designations for a ball being stopped by a red or a black stop, such as those shown in FIG. 3. A wager may be placed for any of the balls to be stopped and therefore, not finish, in a red or black stop, including the discrete stops, the channel stops, or the side stops. The betting table 80 also has wagering designations for what color ball will finish first. Since a standard set of billiard balls has two of each color but only one black, the eight ball, and one white ball, the que ball, the pay-off values are different for the colored ball wagering designations, or race result designations. The pay-off for a white or black ball to finish first is 10 to 1, whereas the pay-off for a colored ball, wherein there are two of each color in standard set of billiard balls, is 5 to 1. There are wagering designations for selecting what ball will finish first based on ball number designations, 1-15, as well as the que ball. There are traditional finishing order wagering designations including, Superfecta, Exacta, Trifecta, Quinella, and the like, as shown. There are also wagering designations for one of a plurality of balls to finish first, including "pick 3", "pick 4", and either a solids or stripes wagering designations. Wagering may be accomplished by placing a wager 84 amount on a wager location as shown in FIG. 11, or a participant may fill out a wagering card that has any number of wagering types listed thereon. A participant may then place a wager at a wagering window that is staffed by a person. Finally, a participant may input a wager electronically using any suitable electronic device.

TABLE 1

| Reference Character Legend | |
|---|---|
| 12 Ball Race Wagering Game Apparatus | 46 Channel deflectors |
| 16 Balls | 46' Channel deflectors |
| 17 Striped ball | 47 Channel opening |
| 19 Centerline | 48 pinning deflector |
| 20 First Run | 49 Colored stop black |
| 21 First decline plane | 49' Colored stop red |
| 22 Elevated starting end | 50 Shortcut conduit |
| 24 Lower end | 52 Shortcut conduit inlet |
| 25 Length | 54 Shortcut conduit outlet |
| 26 Left side wall | 55 Transfer conduit inlet |
| 26' Right side wall | 56 First Transfer conduit |
| 27 Width | 56' Second Transfer conduit |
| 28 Drop height | 58 Transfer conduit outlet |
| 29 Decline angle | 60 Starting block |
| 30 Second Run | 61 Starting chamber |

TABLE 1-continued

| Reference Character Legend | |
|---|---|
| 31 Second decline plane | 62 Starting shield |
| 32 Elevated starting end | 64 Start drop height |
| 34 Lower end | 70 Finishing Collector |
| 36 Left side wall | 74 Solid colored ball |
| 36' Right side wall | 76 Finish indicators |
| 39 Decline angle | 80 Betting table |
| 40 Plurality of deflectors | 82 Betting locations |
| 40' Plurality of deflectors | 83 Betting designation |
| 41 Activation button | 84 Betting Chip |
| 42 Block shaped deflectors | 90 Channel stop black |
| 42' Cylindrically shaped deflectors | 90' Channel stop red |
| 43 Wall stop | 92 Side stop black |
| 44 Wall deflectors | 92' Side stop red |
| 45 Roll deflector | |

It will be apparent to those skilled in the art that various modifications, combinations and variations which can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope, of the appended claims and their equivalents.

What is claimed is:

1. A method of wagering on a rolling ball-race game comprising the steps of:

a) providing a rolling ball-race game betting apparatus comprising:

i) a first decline plane having an elevated starting end and a lower end and comprising a plurality of discrete deflectors;

ii) a second decline plane having an elevated starting end and a lower finish end and comprising a plurality of discrete deflectors;

wherein the first decline plane lower end is offset from said elevated starting end of the second decline plane by a vertical offset distance of about 5 inches or more;

iii) a plurality of ball-stops;

iv) at least one rotating deflector;

v) a shortcut conduit from the first decline plane to the second decline plane;

vi) a plurality of balls each having a designation marking; and vii) a finish collector configured to align the balls in-line in the order in which they finish;

wherein the rolling ball-race game apparatus is configured to determine an order of balls finishing a race, wherein a plurality of balls are configured to roll from the starting end to the lower end of the first decline plane, and then drop down, to the starting end of the second decline plane and roll to the lower finish end of the second decline plane, and subsequently into the finish collector;

b) placing a wager on a wager-race-result of the plurality of balls;

c) starting the plurality of balls at the starting end of the first decline plane;

d) allowing at, least some of the plurality of balls to roll down along the first decline plane, e) allowing at least some of the plurality of balls to enter into the shortcut conduit;

f) allowing at least some of the plurality of balls to roll onto the starting end of the second decline plane;

g) allowing at least some of the plurality of balls to be caught in the plurality of ball-stops;

h) allowing at least some of the plurality of balls to enter into the finish collector;

wherein a ball that enters the finish collector first, is a first place finisher ball;

wherein a ball to enter the finish collector second, is a second place finisher ball;

wherein a ball to enter the finish collector third, is a third place finisher ball;

wherein a ball to enter the finish collector fourth, is a fourth place finisher ball;

i) determining a final finish order of the plurality of balls in the finish collector;

j) determining which of said plurality of balls did not finish; and k) receiving a winning that is more than said wager in the event that said wager-race-result matches a final-race-result.

2. The method of wagering of claim 1, wherein the plurality of balls have numerical designation markings.

3. The method of wagering of claim 2, wherein the plurality of balls comprise a ball with a numerical designation of 1 through at least 8.

4. The method of wagering of claim 2, wherein the step of placing a wager on a wager-race-result comprises placing a wager on said first, second, or third place finisher ball as determined by the numerical designation markings.

5. The method of wagering of claim 2, wherein the step of placing a wager on a wager-race-result comprises placing a wager of an exact order of a first, second third, and fourth place finisher ball.

6. The method of wagering of claim 1, wherein the plurality of balls have different color designation markings and wherein the step of placing a wager on a wager-race-result comprises placing a wager on a color designation marking of the first place finisher ball.

7. The method of wagering of claim 1, wherein at least a portion of the plurality of balls have a stripe designation marking and wherein the step of placing a wager on a wager-race-result comprises placing a wager on one of said portion of the plurality of balls having the stripe designation marking being the first place finisher ball.

8. The method of wagering of claim 1, wherein at least a portion of the plurality of balls have a solid color designation marking and wherein the step of placing a wager on a wager-race-result comprises placing a wager on one of said portion of the plurality of balls having the solid color designation marking being the first place finisher ball.

9. The method of wagering of claim 2, wherein the step of placing a wager on a wager-race-result comprises placing a wager on one of a set of three balls, each of said balls in said set having different numerical designation and any one of said set of three balls being the first place finisher ball.

10. The method of wagering of claim 9, wherein the set of three balls consists of a ball with a number 1 numerical designation, a ball with a number 2 numerical designation and a ball with a number 3 numerical designation.

11. The method of wagering of claim 2, wherein the step of placing a wager on a wager-race-result comprises placing, a wager on one of a set of four balls, each of said balls in said set having different numerical designation, and any one of said set of four balls being the first place finisher ball.

12. The method of wagering of claim 11, wherein the set of four balls consists of a ball with a number 1 numerical designation, a ball with a number 2 numerical designation, a ball with a number 3 numerical designation and a ball with a number 4 numerical designation.

13. The method of wagering of claim 1, wherein the step of placing a wager on a wager-race-result comprises placing a wager on one of the plurality of balls to not finish and not entered into the finish collector.

14. The method of wagering of claim 13, wherein a portion of the plurality of stops, have a stop designation color, and wherein the step of placing a wager on one of the plurality of balls to not finish and not entered into the finish collector also comprises placing a wager on the stop designation color wherein said one of the plurality of balls is stopped.

15. The method of wagering of claim 1, wherein the step of placing a wager on a wager-race-result comprises placing a wager on a last place finisher ball, a ball that is stopped higher than any other ball on the second decline plane by one of the plurality of stops or a ball to enter the finish collector last in the event that more of the plurality of balls are stopped on the second decline plane.

16. The method of wagering of claim 1, further providing a betting table comprising a plurality of betting locations, each having a wager-race-result designation and wherein the step of placing a wager on a wager-race-result of the plurality of balls comprises placing said wager onto one of the plurality of betting locations.

17. The method of wagering of claim 16, wherein one of the wager-race-result designations comprises a designation markings of one of the plurality of balls being a first place finisher ball.

18. The method of wagering of claim 16, wherein one of the wager-race-result designation comprises a designation markings of one of the plurality of balls to not finish and not entered into the finish collector.

19. The method of wagering of claim 1, further providing a betting slip comprising a plurality of betting locations each having a wager-race-result designation and wherein the step of placing a wager on a wager-race-result of the plurality of balls comprises marking one of the plurality of betting locations.

20. The method of wagering of claim 19, wherein the betting slip comprises at least nine different wager-race-result designation.

* * * * *